United States Patent [19]

Ishikura et al.

[11] Patent Number: 4,480,157

[45] Date of Patent: Oct. 30, 1984

[54] OVERHEAD RUNNING CARRIER

[75] Inventors: Takashi Ishikura; Joji Mino; Kiyomi Sato; Takaaki Nagato, all of Osaka, Japan

[73] Assignee: Tsubakimoto Chain Company, Osaka, Japan

[21] Appl. No.: 401,860

[22] Filed: Jul. 26, 1982

[30] Foreign Application Priority Data

Nov. 27, 1981 [JP] Japan ..... 56-189114

[51] Int. Cl.[3] ..... B61B 3/02; E01B 25/22; B60L 5/38; B60M 1/30

[52] U.S. Cl. ..... 191/34; 191/42; 191/45 A; 104/93; 105/150

[58] Field of Search ..... 104/89, 93, 110; 105/101, 148, 150; 191/29 R, 32, 34, 40, 45 A, 42

[56] References Cited

U.S. PATENT DOCUMENTS

| | | | |
|---|---|---|---|
| 928,435 | 7/1909 | Feltz | 105/154 X |
| 1,256,073 | 2/1918 | Stevenson | 104/93 X |
| 2,017,404 | 12/1933 | Lorig | 104/93 |
| 2,470,060 | 5/1949 | Webb et al. | 105/154 |
| 2,488,523 | 11/1949 | Bilger | 104/93 X |
| 2,830,137 | 4/1958 | Herrmann et al. | 191/45 A X |
| 2,958,743 | 11/1960 | Moore | 104/93 X |
| 2,976,818 | 3/1961 | Bingham | 105/150 |
| 3,092,039 | 6/1963 | Lich | 105/150 |
| 3,190,646 | 6/1965 | Forsman | 104/93 X |
| 3,217,659 | 11/1965 | Ford, Jr. | 104/89 X |
| 3,252,429 | 5/1966 | Atanasoff et al. | 104/93 X |
| 3,261,304 | 7/1966 | Henderson | 105/148 X |
| 3,319,580 | 5/1967 | Bohm | 104/89 X |
| 3,518,945 | 7/1970 | Raney et al. | 104/93 X |
| 3,587,473 | 6/1971 | Weiss et al. | 104/93 |
| 3,625,158 | 12/1971 | Lorenz et al. | 104/93 |
| 3,855,941 | 12/1974 | Fromme et al. | 105/150 |
| 3,884,153 | 5/1975 | Sugimoto | 104/93 |
| 3,935,822 | 2/1976 | Kaufmann | 104/93 |
| 3,949,679 | 4/1976 | Barber | 104/89 X |
| 3,987,734 | 10/1976 | Horn | 104/89 X |
| 4,049,092 | 9/1977 | Lillard et al. | 191/40 |
| 4,056,064 | 11/1977 | Bottomley | 104/93 |
| 4,109,768 | 8/1978 | Fromme et al. | 191/32 X |
| 4,171,670 | 10/1979 | Roberts | 104/93 |
| 4,393,785 | 7/1983 | Hörtnagel | 191/32 X |

FOREIGN PATENT DOCUMENTS

| | | | |
|---|---|---|---|
| 2343263 | 8/1973 | Fed. Rep. of Germany | 105/150 |

*Primary Examiner*—Robert B. Reeves
*Assistant Examiner*—David F. Hubbuch
*Attorney, Agent, or Firm*—Dann, Dorfman, Herrell and Skillman

[57] ABSTRACT

An overhead conveyor comprising a monorail and a carrier supported on the monorail. In the illustrated embodiment, the monorail is generally I-shaped in cross section and the carrier comprises two carriages spaced apart along the monorail having a roller adapted to ride on the top of the monorail and guide rollers adapted to engage the sides of the monorail to provide lateral stability. The two carriages are interconnected by a load beam pivotally mounted on vertical pins in each of the carriages. One of the carriages carries a drive motor for advancing the carrier along the rail and the other of the carriages provides an electrical pick-up device for taking power from trolley lines mounted on the monorail and supplying power to the drive motor.

11 Claims, 8 Drawing Figures

OVERHEAD RUNNING CARRIER

FIELD OF THE INVENTION

The present invention relates to conveyors and more particularly to overhead conveyors in which a carrier is supported by and travels on an elevated monorail, for example in an industrial plant.

BACKGROUND OF THE INVENTION

Overhead conveyors of this type are normally designed to cooperate with a monorail in the form of a box beam having a medial slot on the under side through which the carrier projects so that the rollers of the carrier travel on lower flanges within the box beam. Alternatively the monorail comprises an I-beam and the carrier is designed to engage over the lower flange of the I-beam and ride on the upper surface thereof. In each case the construction limits the size of the wheels used to support the carrier on the monorail and necessitates the use of an increased number of wheels when transporting heavy loads. Furthermore the arrangement limits the curvature which may be imparted to the monorail without danger of binding between the carrier and the rail and causing excessive wear unless specially treated rails are used. Such prior art conveyors also are noisy in operation and are heavy in weight.

The present invention provides a novel conveyor arrangement which overcomes the difficulties present in the prior art conveyors of this type.

SUMMARY OF THE INVENTION

The present invention provides a carrier arrangement which is susceptible of supporting heavy loads and enables the monorail to be designed with sharp curves without adversely affecting the operation of the conveyor.

The present invention also provides a conveyor assembly which is easy to install and maintain and permits the carrier to be self driven.

The carrier construction provides a load beam which supports the load without imparting excessive strain to the carriages.

More specifically, the present invention provides a conveyor system in which the carrier is designed to ride upon a monorail having an upstanding web and at least one horizontally disposed plate on the upper surface. The carrier comprises a pair of carriages, e.g. one driving carriage and one driven carriage, which are spaced apart. Each carriage has a supporting wheel which travels on the upper surface of the plate. The carrier is self-driven by an electric motor carried by the carrier and fed with electricity from trolley buses extending along the length of the monorail, the carrier having slide shoes adapted to provide the necessary electrical connections between the bus means and the electric motor.

Preferably the monorail is of I-beam cross section and the carrier is E-shaped in cross section to receive the I-beam between the upper and intermediate arms thereof. A load beam is pivotally mounted on the two carriages between the intermediate and lower arms thereof, and suitable lateral guide rollers engage the sides of the monorail to provide lateral stability for the carriages.

The trolley buses are formed of conductive rails housed within insulating sheaths mounted on the web of the monorail by mounting blocks spaced along the length thereof. The sheath is of C-shaped cross section so as to expose a portion of the conductor rail for engagement by the slide shoes of the electrical connecting means.

BRIEF DESCRIPTION OF THE DRAWINGS

The foregoing advantages of the invention and the construction of a preferred embodiment are more fully set forth hereinafter with reference to the accompanying drawings wherein.

DESCRIPTION OF THE PRIOR ART

Figure 1:
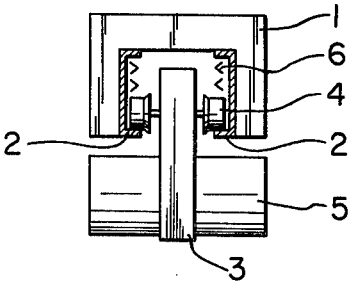
FIG. 1 PRIOR ART
FIGS. 1 and 2 are schematic front elevational views of two different types of prior art carriers, the monorails therefor being in transverse section.

In FIG. 1, a prior art carrier is shown for cooperation with a monorail 2 composed of a pair of confronting C-shaped channel members fixed to a supporting structure 1. The carrier 3 has right and left wheels 4 which travel on the lower flanges of the confronting channel members of the rail 2. Trolley lines or buses 6 are provided within the channel members for feeding power to a running motor 5 mounted on the carrier 3 below the rail. The illustrated arrangement provides a safe enclosure for the trolley lines, but the position of the trolley lines may interfere with the wheels 4 and requires that the wheel diameter be relatively small. When transporting heavy loads by the carrier 3, the carrier must include a large number of wheels and the use of a large number of wheels restricts the curvature which may be provided in the monorail. In any event, the travel of the wheels 4 within the monorail produces a creaking sound and excessive running noises. This arrangement generates considerable wear and to avoid failures, a special quenched rail must be used which entails a considerable additional weight.

Figure 2:
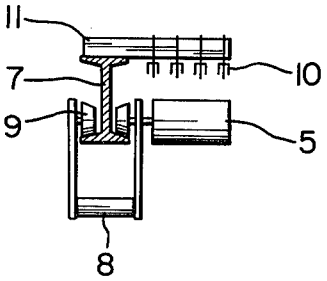
FIG. 2 PRIOR ART

In the prior art structure shown in FIG. 2, a carrier 8 is suspended from a rail 7 in the form of an I-beam. As shown, the carrier 8 has wheels 9 engaging on the upper surface of the lower flange of the I-beam, one of the wheels having an electric motor for driving the carrier. In this instance a supporting member 11 is mounted on the top flange of the I-beam and projects outwardly to support trolley lines or buses 10 for feeding electricity to the motor 5. With this arrangement, the diameter of the wheel may be increased within the clearance between the upper and lower flanges, but the arrangement is noisy in operation and is subject to considerable wear. Because of the suspended nature of the trolley lines or buses 10 the mounting cannot be as precise as in the previous structure and it is necessary to provide a greater degree of freedom for the collectors which ride along the trolley buses thereby requiring the connecting structure to be larger and more space-consuming.

DESCRIPTION OF THE PREFERRED EMBODIMENT

The present embodiment of the invention provides an overhead running carrier in which the above-mentioned disadvantages of prior art structures are eliminated. The present invention provides sufficient adaptability which accomodates a frequent repetition of starting and abrupt stopping of the carrier and also accomodates any centrifugal force generated by passage of the carrier around sharply-curved parts in the monorail. The monorail may be small in size, but is of substantial durability and facilitates both the mounting and maintenance of the buses used for feeding power and signals to the carrier.

Figure 3:
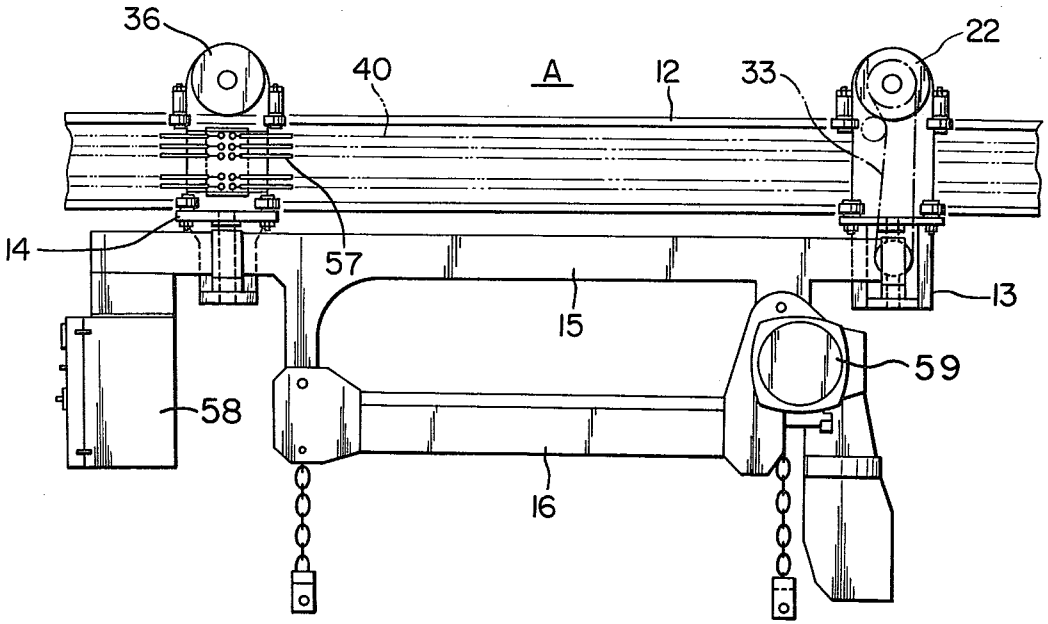
FIG. 3 is an overall side elevational view, portions being shown schematically, of a preferred embodiment of the present invention.

As shown in FIG. 3, a carrier A is provided with a pair of carriages 13 and 14 which run on a rail 12 having a generally I-shaped cross section. The carriage 13 is a driving carriage and the carriage 14 is a driven carriage. The carriages 13 and 14 are connected by a load bar 15 having an electrically operated chain hoist 16 associated therewith.

Figure 5:
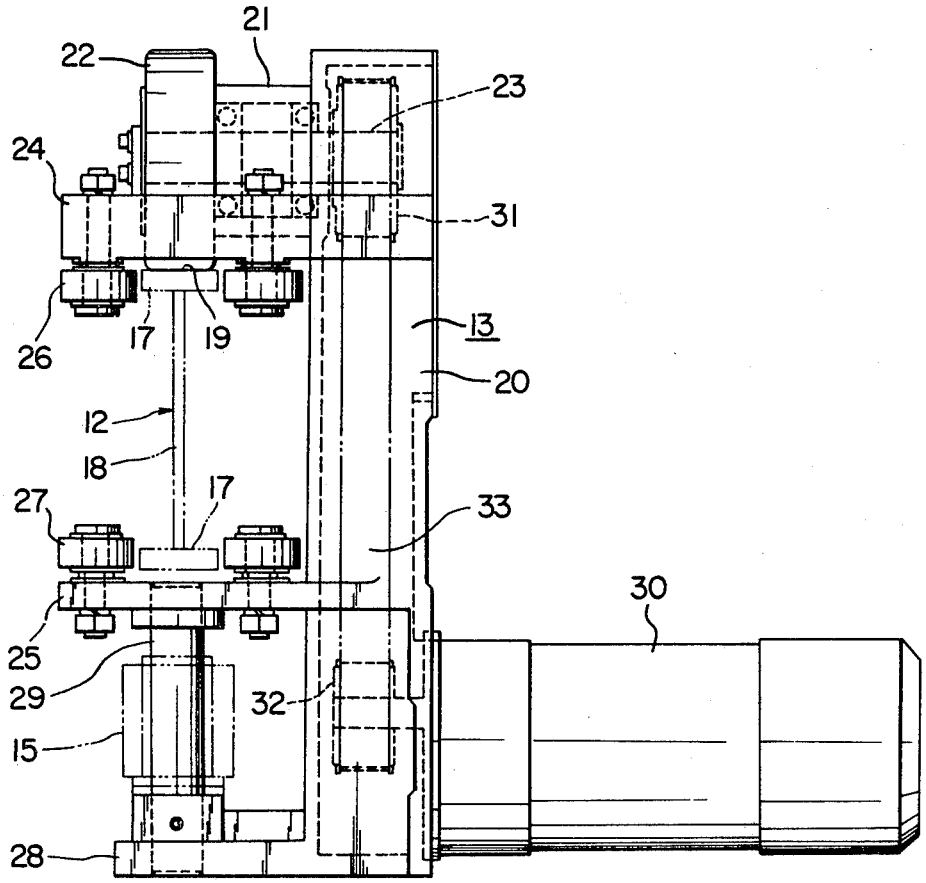
Figure 7:
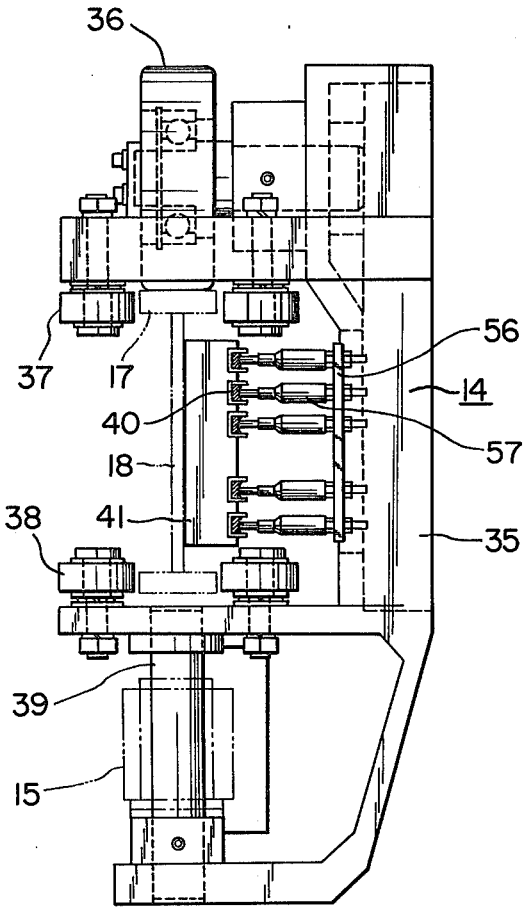
Figure 8:
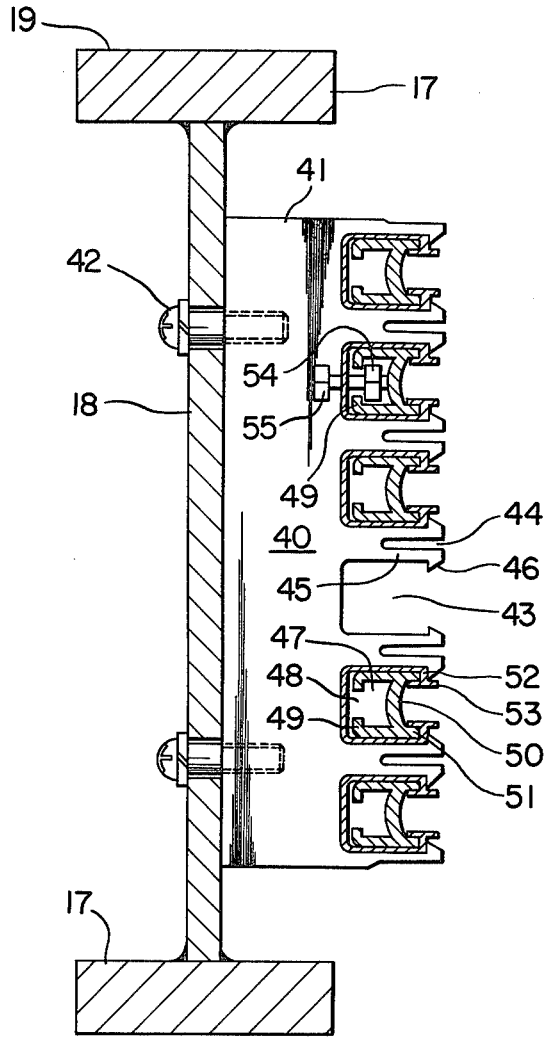
FIG. 8 is a cross section through the monorail shown in phantom lines in FIGS. 4 to 7 inclusive and shows the installation of the trolley lines or buses on the vertical web thereof.

As shown in FIG. 8, the rail 12 is preferably fabricated in three parts and welded together. As shown in FIGS. 5, 7 and 8, the rail 12 has upper and lower flat plate members 17 welded at the upper and lower edges of an upstanding web 18. The monorail 12 is hung on a ceiling or other supporting structure by conventional supporting fittings (not shown) which project rearwardly from the web 18. Since the rail 12 is formed so that the plate members are welded to both the top and bottom edges of the web 18, there is considerable flexibility in designing the rail, and it is possible to produce a small and light-weight rail suited for the particular loads applied thereto. The sizes of the plates 17 and the web 18 may be selected to provide a rail having light-weight and sufficient strength with reference to their actual conditions of operation. As set forth below, the upper plate 17 is the primary load-bearing member while the lower plate 17 is provided for lateral stability. The web 18 provides reinforcement and supports the plates 17 and also provides a mounting for the trolley buses. Thus the rail 12 may be made of steel, non-ferrous material, or, in certain cases, non-metallic material may also be used. By reason of the fabricated construction of the rail, the several parts may be of different materials according to the requirements of its use. In installation, the rail must include curves to enable the carriers to travel around corners and the like, and to this end the curved sections of the rail may be formed by bending the fabricated rail 12 after the welding operation. The smaller the width of the plate member 17, the less is the distortion or inclination of the upper surface 19 of the upper plate member 17 toward its side edges due to bending the formation. For this reason, the radius of curvature of the monorail may be substantially increased to provide a sharply-curving rail section.

Figure 4:
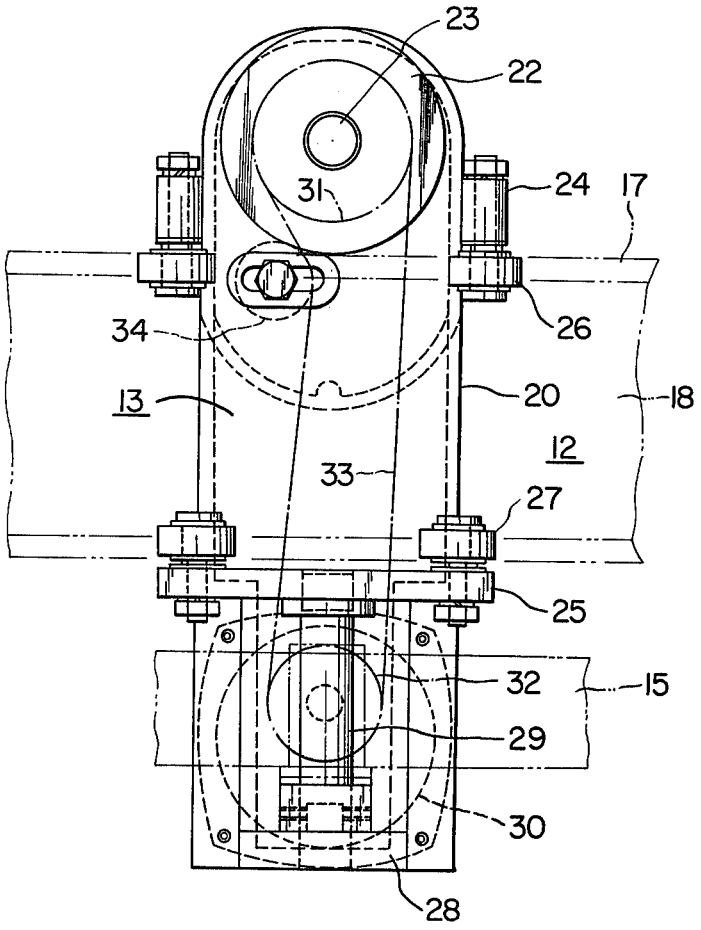
FIGS. 4 and 5 are side and front elevational views of the driving carriage of the carrier shown in FIG. 3.

The driving carriage 13 of the carrier A, as shown in FIGS. 4 and 5, rides on the upper surface 19 of the rail 12 and is vertically supported by the upper plate 17. The frame 20 of the carriage 13 is generally E-shaped with an upper arm 24, an intermediate arm 25 and a lower arm 28, the upper and intermediate arms 24 and 25 being positioned above and below the monorail 12. The upper part of the frame 20 mounts a bearing 21 for a transverse axle 23 having a cylindrical wheel 22 which supports the carriage 13 on the upper surface 19 of the rail 12. Preferably the wheel 22 is of non-metallic material, for example rubber or synthetic resin so as to minimize wear on the rail and to reduce the noise. Lateral stability is provided to the carriage 13 by vertical-axle guide rollers 26 and 27 mounted on the upper and intermediate arms 24 and 25 respectively. The upper rollers 26 are in a set of four and are preferably of rubber or synthetic resin to bear against the side edges of the upper plate member 17. The lower guide rollers 27 project upwardly from the intermediate arm 25 and are arranged in a set of four to bear against the opposite side edges of the lower plate 17. The guide rollers are spaced from the edges of the plate 17 with sufficient clearance to permit the carriage to pass around the curved section of the rail without binding, or may be of sufficiently soft material to permit compression of the rollers to avoid interference with the passage of the carriage around the sharply curved section of the monorail. The upper guide rollers 26 prevent swerving of the wheel and maintain it substantially centrally on the upper surface 19 and the guide rollers 27 prevent lateral swinging movement of the carriage 13. If desired, only a single pair of guide rollers may be used to provide the lateral stability and maintain the carriage in registry with the rail.

The lower part of the frame 20 pivotally supports one end of the load bar 15. To this end a vertical pin 29 is fitted into holes in the intermediate arm 25 and the lower arm 28 of the frame. The axis of the pin is preferably vertically aligned through the center of the wheel 22 and the pin is fixed in place by collars as shown in FIG. 5. The load bar 15 is pivotally mounted on the pin 29 by a bushing so that the load arm may swing about the pivotal axis of the pin 29 as the carrier A passes around the sharply curved sections of the monorail.

The driving carriage 13 is self-driven, in the present instance by a speed-reduction motor 30, mounted at the lower end of the frame 20 and projecting outwardly therefrom, as shown in FIG. 5. The motor 30 includes a motor-driven pulley 32 mounted on a rotary axis parallel to the axle 23 for the wheel 22. The wheel axle 23 has a pulley 31 mounted thereon for rotation with the wheel 20 so that the wheel may be driven by the motor 30 by a toothed belt 33 trained over the pulleys 31 and 32 as shown diagramatically in FIG. 4. The toothed belt is kept tensioned by an idler pulley 34 mounted on the frame 20 for lateral adjustment as shown in FIG. 4.

Figure 6:
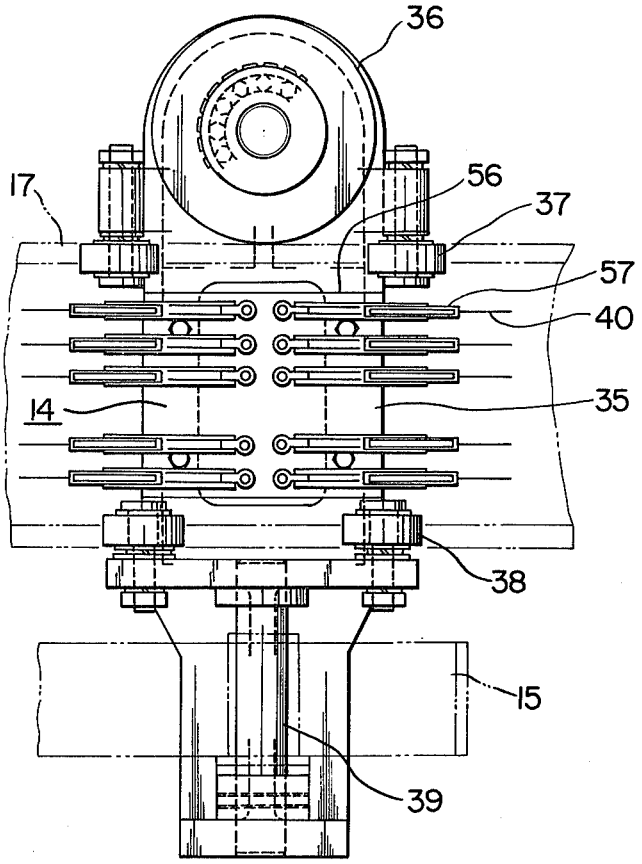
FIGS. 6 and 7 are side and front elevational views of the driven carriage of the carrier of FIG. 3.

The driven carriage 14 is similar to the carriage 13, and has, as shown in FIGS. 6 and 7 an E-shaped frame 35 mounting a cylindrical wheel 36, guide rollers 37 and 38 and a pin 39. The pin 39 pivotally supports the other end of the load bar 15 similarly to its mounting on the pin 29 to permit passage of the carrier A about sharp corners. The carriage 14 is driven by the load bar 15 which is advanced by the carriage 13 and does not have a motor. The carriage 14 is provided with collector means in the form of slide shoes 57 for receiving power from the trolley lines or buses 40 mounted on the upstanding web 18 of the monorail 12. An electrical connector (not shown) extends from the slide shoes 57 to the motor 30. The electrical conductor not only transmits power from the buses 40 to the motor 30, but also transmits control signals from the buses 40 to this unit, as set forth more fully hereinafter.

The trolley lines or buses 40 are mounted on the front side of the web 18 so as to afford easy mounting and maintenance of the electrical system. To this end, as shown in FIG. 8, mounting blocks 41 are fixed in spaced-apart relation along the monorail 12, for example by screws or bolts 42. The mounting block supports the trolley buses 40 on the front side of the web 18 which confronts the frame 35 of the driven carriage 14. Each mounting block 41 has several grooves 43 and recessed concave portions 44 between the grooves which are arranged in the outwardly directed portions of the mounting blocks to form resilient deformable legs 45 at opposite sides of the groove 43. The free ends of the legs 45 are formed with latch portions 46 which project into the groove as shown in FIG. 8.

Each of the trolley lines or buses 40 is preferably an extruded member having a substantially H-shaped configuration with parallel legs 51 having an intermediate cross piece 50. The member forms a hollow rectangular part 47 at one side of the cross piece 50 which is directed inwardly toward the web 18 and terminates in a longitudinal opening between the free ends of the legs 51 which have inwardly projecting foot portions 49 defining the opening 48. The wall of the cross piece 50 which faces oppositely to the opening 48 is slightly inwardly concaved (bulged-out toward the opening 48) so as to facilitate the outer surface acting as a sliding contact surface between the legs 51 projecting outwardly at both sides thereof.

In assembly, each of the trolley lines or buses 40 is fitted into an insulation sheath 52 having a C-shaped cross section and is held by projecting fingers 53 formed at both edges of said sheath to embrace the projecting parts of the legs 51. The assembly is then press-fitted into the proper groove 43 of the successive mounting blocks and is held therein by the latching parts 46. In order to provide electrical connections to the extruded bus 40, a connector fitting 54 is mounted between the legs 51 in the hollow part 47 and a screw or bolt 55 is threadably inserted through the opening 48 and is fastened so that the leading end of the fastener is forcedly contacted against the inner wall of the cross piece 50 to cause both sides of the fitting 54 to forcedly contact against the inner surfaces of the two foot portions 49.

In order to enable the transmission of control signals, the upper three trolley lines 40 shown in FIG. 8 are power supply lines for the motor 30 and the hoist drive 59, and the lower two are control signal lines. In the latter lines, a specific section is normally insulated from other sections and may control the forwarding movement or stopping movement of the carrier A. The mounting of the trolley lines 40, as described above, provides an insulated sheath which may be penetrated by the fastener 55 so as to project slightly rearwardly without contacting the web 18. The mounting blocks assure a highly precise and compact mounting of the buses while permitting the lines or buses to be exposed along the length of the monorail.

Means is provided to assure proper interconnection between the carriage and the trolley lines. To this end slide shoes 57 are mounted on the driven carriage 14 in sliding contact with each of the trolley lines 40. Preferably the shoes 57 are mounted in an insulation block or plate 56 fixed by screws (not shown) to the frame 35 of the carriage 14. Since lateral vibration of the carriage 14 is limited by the guide rollers, as described above, it is possible to obtain a good electrical contact and pick-up by using small-sized collector shoes which have only a limited degree of movement toward the rail.

The chain hoist 16 may also be powered by the trolley buses 40. To this end a second electrical connector (not shown) extends from the shoes 57 on the insulator block 56 to a control box 58 for the hoist and electrical connections (not shown) from the box 58 to the drive mechanism 59 of the hoist are provided. Thus the hoist may be operated from the same power as the carrier by suitable manipulation of the controls in the control box 58.

The pivotal mounting of the load bar 15 on the two carriages provides assured operation, since both ends of the load bar are supported by vertical pins 29 and 30. This mounting provides a highly strong resistance against inertia of the material carried by the load bar 15 when the carrier A is abruptly stopped or a bending moment is applied to the pins when transporting the load along a sloped portion of the rail.

In addition to, or in place of, the chain hoist 16, a load may be fixed to the load bars by a hanger (not shown). Preferably the hanger is supported in the load bar 15 by a ball bearing to to isolate the load bar 15 from swinging forces applied by the load on the hanger. In this case, since the pins 29 and 39 support both ends of the beam against any centrifugal force generated by the transported article as it is carried around a curved part of the rail, the pins maintain sufficient strength and isolate the guide rollers from lateral forces so as to remarkably decrease the pressures on the rollers and extend their life.

It should be noted that since the cylindrical wheels 22 and 36 run on the flat upper surface of the monorail, there is wide latitude in the selection of a wheel diameter to provide the desired surface pressure without having to consider the dimensions of the rail which underlie these wheels. Since the wheel rides on the flat upper surface 19 there is no lateral force applied to the wheel by the rail even when the wheel travels around the curved parts of the monorail. Thus the material of the wheels 22 and 36 may be selected from rubber or synthetic resin thereby minimizing the generation of noise and wear.

The mounting of the trolley buses 40 on the forwardly directed surface of the web 18 and, providing an insulating sheath as described, enables facile maintenance of the lines 40 and permits replacement or modification of the electrical connections as required. This structure also enables the use of slide shoes of limited size and without costly adjustable mountings.

The toothed belt interconnection between the drive motor 30 and the wheel 22 enables the motor to be positioned at the most convenient location so as not to interfere with the mounting arrangements for the monorail and avoids the problems of rail junctions which occurred in prior art installations.

The toothed belt is normally sufficiently resilient to provide a shock-absorbing action when the motor 30 is started and stopped abruptly thereby minimizing the impacts upon the operating mechanisms of the carriages. The toothed belt interconnection of this embodiment avoids the maintenance problems inherent in the prior art gear-driven system, such as the need for lubrication and adjustment of the gears.

It should be noted that the pins 29 and 39 which anchor the opposite ends of the load bar are firmly seated in their respective carriages so as to resist any distortion by reason of the inertia of the load suspended from the load bar during starting and stopping and also during movement of the carrier A around sharply curved parts of the monorail.

Furthermore, since the trolley lines 40 are mounted on the exposed surface of the web 18 the condition of the lines may be visually inspected and maintenance operations on the lines are greatly facilitated.

While a particular embodiment of the present invention has been herein illustrated and described it is not intended to limit the invention to such disclosure, but changes and modifications may be made thereto within the scope of the following claims.

What is claimed is:

1. An overhead running carrier for running on an I-beam monorail having an upstanding web and two vertically-spaced horizontally-disposed plates, the upper one of said plates being at the top of said web and constituting a load-bearing member, said carrier comprising a driving carriage adapted to travel along said monorail;

a driven carriage spaced from said driving carriage and adapted to run along said monorail;

a load bar spanning between said carriages;

each of said carriages having a horizontal axle above said upper plate and a supporting wheel mounted on said axle providing a rolling support for the associated carriage along the top of said upper plate, and two sets of four guide rollers, an upper set engaging the opposite sides of the upper plate of said monorail, and a lower set engaging the opposite sides of the lower plate of said monorail, the rollers of said upper and lower sets of rollers being mounted for rotation about vertical axes and engaging the opposite side edges of the respective plates;

an upright pin mounted on each of said carriages to support said load bar for pivotal movement thereon;

trolley bus means mounted on said monorail and extending parallel to said web;

electrically-actuated drive means carried by said carrier and operable to drive said driving carriage along said monorail;

said electrically-actuated drive means comprising a motor and a motor-driven pulley on said driving carriage rotatable on an axis parallel to said axle, a second pulley mounted for rotation with said supporting wheel, and a toothed drive belt interconnecting said pulleys so as to drive said wheel upon actuation of said motor-driven pulley; and electrical connections carried by said driven carriage having collector shoes slidably engaging said trolley bus means to energize and control said electrically-actuated drive means.

2. A carrier according to claim 1 wherein said monorail is fabricated from at least three pieces including the upper load-bearing plate, the upstanding web, and the lower plate, said pieces being bonded together into an integral structure.

3. A carrier according to claim 1 wherein the supporting wheel of each carriage comprises non-metallic material engaging said load-bearing plate.

4. A carrier according to claim 3 wherein said material is rubber.

5. A carrier according to claim 3 wherein said material is a synthetic resin.

6. A carrier according to claim 1 wherein each of said carriages is generally E-shaped having an upper arm above said monorail providing a support for said upper set of guide rollers, an intermediate arm below said monorail providing a support for said lower set of guide rollers and the upper end of said upright pin, and a lower arm supporting the lower end of said upright pin, said load bar being journalled on said pin between said intermediate and lower arms.

7. A carrier according to claim 6 wherein said rollers of the lower of said sets project upwardly from said intermediate arm and engage said lower plate at its opposite edges and the rollers of the upper of said sets depend downwardly from said upper arm and engage the opposite edges of said load-bearing plate.

8. A carrier according to claim 6 wherein said collector shoes are mounted between the upper and intermediate arms of said driven carriage and have connections to the motor of said motor-driven pulley on said driving carriage.

9. A carrier according to claim 1 wherein said trolley bus means comprises a series of individual conductor rails disposed in spaced parallel coplanar relationships along said web, each rail being enclosed in an insulating sheath of C-shaped cross section, said sheath exposing a portion of said rail for sliding contact by one of said collector shoes.

10. A carrier according to claim 9 including a series of mounting blocks secured to said web at spaced locations therealong, said blocks having grooves to receive the insulating sheaths and rails.

11. A carrier according to claim 9 wherein said rails are H-shaped in cross section with parallel legs and an intermediate cross piece, said rail being mounted in said C-shaped sheath so that one-surface of said intermediate cross piece is exposed for sliding contact with one of said collector shoes.

* * * * *